United States Patent [19]

Olliges

[11] 4,173,341

[45] Nov. 6, 1979

[54] AMUSEMENT DEVICE USING PERFORATED BOARD

[75] Inventor: William E. Olliges, Barrington Hills, Ill.

[73] Assignee: George H. Gerstman, Northbrook, Ill.

[21] Appl. No.: 906,910

[22] Filed: May 18, 1978

Related U.S. Application Data

[63] Continuation of Ser. No. 707,687, Jul. 22, 1976, abandoned.

[51] Int. Cl.[2] ..... A63F 3/00

[52] U.S. Cl. ..... 273/126 A

[58] Field of Search ..... 273/126 A, 119 R, 118 A, 273/124 A, 124 R, 128 R, 128 C, 128 S, 128 A, 121 R, 121 A, 125 R, 125 A, 123 R, 123 A, 127 R, 127 B, 122 R, 122 A, 85 R, 85 A, 85 C, 85 D, 85 F, 85 H, 129 HB, 129 R, 129 HA, 87 R, 87.2, 87.4

[56] References Cited

U.S. PATENT DOCUMENTS

| | | | |
|---|---|---|---|
| 2,166,228 | 7/1939 | Wilsey | 273/121 A |
| 2,181,388 | 11/1939 | Wells | 273/121 A |
| 2,582,844 | 1/1952 | Mourfield | 273/86 D |
| 2,964,320 | 12/1960 | Lebrum | 273/85 A |
| 3,404,888 | 10/1968 | Lally et al. | 273/121 A |
| 3,647,212 | 3/1972 | Barlow et al. | 273/85 B |
| 3,722,888 | 3/1973 | Ducharme | 273/126 R |
| 4,017,078 | 3/1977 | Goldfarb et al. | 273/126 A |

FOREIGN PATENT DOCUMENTS

| | | | |
|---|---|---|---|
| 1094378 | 5/1955 | France | 273/121 A |
| 1154600 | 4/1958 | France | 273/121 A |
| 409735 | 10/1966 | Switzerland | 273/118 A |

*Primary Examiner*—Richard C. Pinkham
*Assistant Examiner*—T. Brown

[57] ABSTRACT

Air cushion game utilizing a perforated inclined playing board through which air is passed for supporting a disc game piece on a cushion of air. The air is confined in a closed recirculation system which requires minimum power and prevents the importation of impurities. Photosensitive sensors are provided in the board for sensing the passage of the disc to register a player's score.

10 Claims, 5 Drawing Figures

AMUSEMENT DEVICE USING PERFORATED BOARD

This is a continuation of application Ser. No. 707,687, filed July 22, 1976 (abandoned).

BACKGROUND OF THE INVENTION

1. Field of the Invention

This invention relates in general to amusement devices of the "pinball" type and more particularly, to games of skill incorporating a fluid supported game piece.

2. Summary of the Prior Art

A game incorporating an air cushion table for supporting a plastic puck is, for example, shown in U.S. Pat. No. 3,887,187. This type of game, however, utilizes an uncovered, horizontal, largely unobstructed table top and requires two players who alternately strike a plastic puck with a hand-held bat to move the puck into the goal of the other player.

Accordingly, one object of the present invention is to provide a game of skill utilizing an air cushion to support a game piece capable of being kept in play by a single player.

The just-mentioned air cushion table utilizes a fan for supplying an air stream from a plenum chamber through a core of pressed wood to a plurality of air channels each communicating with holes in the playing surface, which is open to the atmosphere.

This is a relatively expensive construction requiring a relatively large fan to maintain the air in movement and permits the importation of impurities into the air stream.

Another object of the present invention is to provide a more economical and efficient construction for a game of skill utilizing an air cushion.

Pinball type apparatus are games of skill in which a single player attempts to keep a game piece in play without direct access to the game piece. The game piece usually comprises a heavy metal ball, which is given an initial impulse by a spring biased plunger to move the ball to the upper end of an inclined board. When the ball rolls down the board, the player attempts to reverse the ball's direction by operating one or more flippers adjacent the bottom of the board for keeping the ball in play. As the ball moves along the board, it encounters various obstacles including the rim or side of the board, bumpers and metal springs. The latter operate associated contacts to register a score for the player so that his score is dependent on how well the player controls the path of ball movement and on how long he can maintain the ball in play.

The parts which the ball encounters are usually covered or lined with a soft material, such as rubber, and the action of the metal ball on these parts and the springs creates considerable wear requiring frequent repair or replacement. The contacts are in addition subject to electrical erosion and their operation is uncertain so that they also require frequent maintenance.

It is therefore a further object of the present invention to provide a more economical and efficient device of the pinball type.

It is also another object of the present invention to reduce the maintenance and repair problem for amusement devices of the pinball type.

SUMMARY OF THE INVENTION

The illustrative embodiment of the present invention proposes to eliminate the heavy game piece or metal ball used in pinball type games by a light game piece formed from a plastic disc. This is made possible through the use of an air stream passed through the playing board for supporting the game piece so that it is easily propelled by the limited power conventional plunger and flippers with sufficient momentum to be under control of the player. The conventional transparent cover member used on such pinball type amusement devices aids in assuring that sufficient pressure is distributed at all locations along the playing board to maintain the game piece suspended on a cushion of air and limits the pressure drop for assuring that the game piece is uniformly suspended. With the light plastic game piece, wear on the parts is substantially reduced to provide similar reductions in maintenance costs.

In addition, in the illustrative embodiment the present invention incorporates a closed system for supplying supporting air for the game piece thereby substantially reducing losses to enable the use of relatively low power economical equipment and also largely eliminate the introduction of impurities into the game area.

The closed system incorporates the top transparent cover member and the housing as boundaries for the air stream and also utilizes the playing board as one boundary of a plenum chamber to thereby provide substantial economies in the construction of a game incorporating an air-supported game piece.

It is therefore still another object of the present invention to provide an amusement device incorporating an economical closed air system for suspending a game piece.

Furthermore, the disc-shaped plastic game piece permits light transmitted through the transparent cover member to be utilized for controlling photosensitive sensing elements to register a player's score. The elements may be placed in the board so that they are controlled in response to the light interruption created when the game piece passes over the sensing elements since the large area of the game piece interrupts sufficient light to enable facile response. Thus the need for spring operated contacts, which are subject to wear, breakage and electrical erosion, may be avoided.

It is therefore another object of the present invention to provide a pinball type amusement device in which the score may be registered without the use of electrical contacts.

The game piece being supported on a cushion of air is capable of considerable velocity or speed thereby creating a considerable and enhanced challenge to player skill.

It is yet another object of the present invention to provide an amusement device of the pinball type having an improved challenge to player skill.

A more detailed explanation of the invention is provided in the following description and claims, and is illustrated in the accompanying drawings.

DETAILED DESCRIPTION OF THE ILLUSTRATIVE EMBODIMENT

Figure 1:
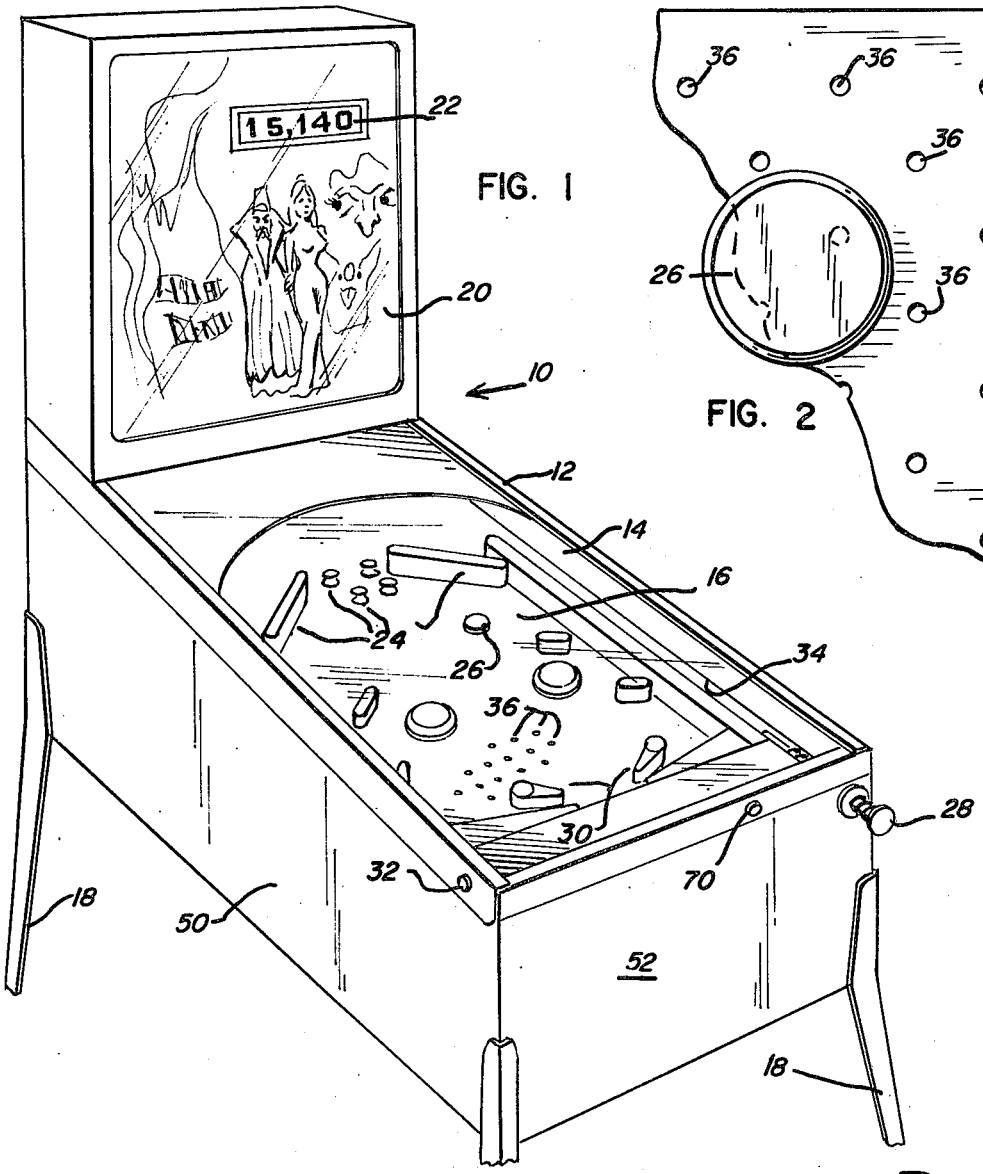
FIG. 1 is a perspective view of an amusement device of the pinball type incorporating the principles of the present invention.

In FIG. 1, an amusement device of the pinball type and incorporating the principles of the invention is indicated by the reference character 10. The amusement device 10 includes a cabinet or housing 12 having a top transparent cover member 14 of glass or the like through which is visible a playing board 16. The housing 12 is usually supported on standards or legs 18 and carries a vertically arranged decorative standard or placard 20 at the back end on which is displayed indicia 22 to indicate the player's score.

The board 16 is formed of any conventional material, such as masonite, and as shown in FIG. 1 carries spaced upwardly projecting bumpers, guides, scoring lamps or playing obstacles 24 of assorted shape, size and location. The playing obstacles 24 may include springs for operating scoring contacts to register the player's score or as will be hereinafter described, the springs and contacts may be omitted. The player, of course, attempts to utilize the obstacles 24 and the rail or rim wall of the board to control the movement of a game piece 26 for achieving as high a score as possible. The game piece or member 26 comprises a plastic disc, which is given an initial movement to start the play by means of a conventional spring-biased plunger rod 28 shown at the front end of housing 12 and the game piece may thereafter be held in play, as will be hereinafter explained, by means of a pair of conventional flippers 30. Flippers 30 are pivoted by means of actuator 32 located at the side of housing 12. Both the plunger rod 28 and flippers 30 have a fixed location relative housing 12 and, of course, can provide only limited power.

The board 16 is inclined upwardly from the front end of housing 12 at an angle of about 5° to a horizontal plane toward the standard 20 at the back end of housing 12 in generally parallel relationship with cover member 14 and after the disc 26 has been initially moved upwardly in one direction through operation of rod 28 to negotiate an initial guideway 34 on board, it moves downwardly along the board 16, while engaging various obstacles or guides 24 until it approaches the flippers 30 at which time the player operates the flippers 30 to reverse the direction in which the game piece 26 moves.

Thus the player attempts to keep the game piece in movement along the board 16 by repetitively reversing its direction of movement through the operation of flippers 30 whenever the game piece comes within range of the flippers to achieve as high a score as possible. If game piece 26 should approach the front end of housing 12 out of range of the flippers either by passing therebetween or around the pivoted ends or if the player operates the flippers too early or too late, the game piece passes the flippers 30 to terminate play.

Figure 2:
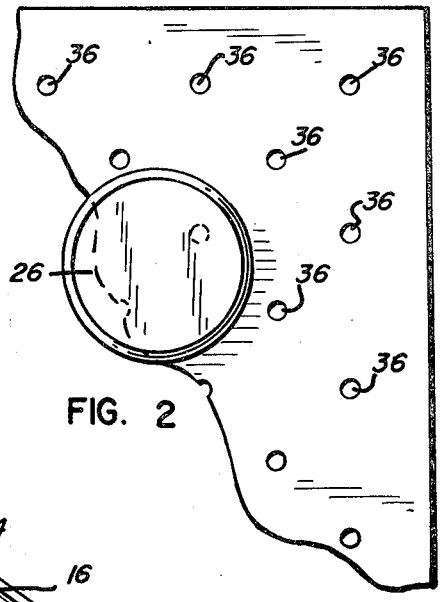
FIG. 2 illustrates a fragmentary portion of the playing board and the game piece utilized in the device shown in FIG. 1.
Figure 4:
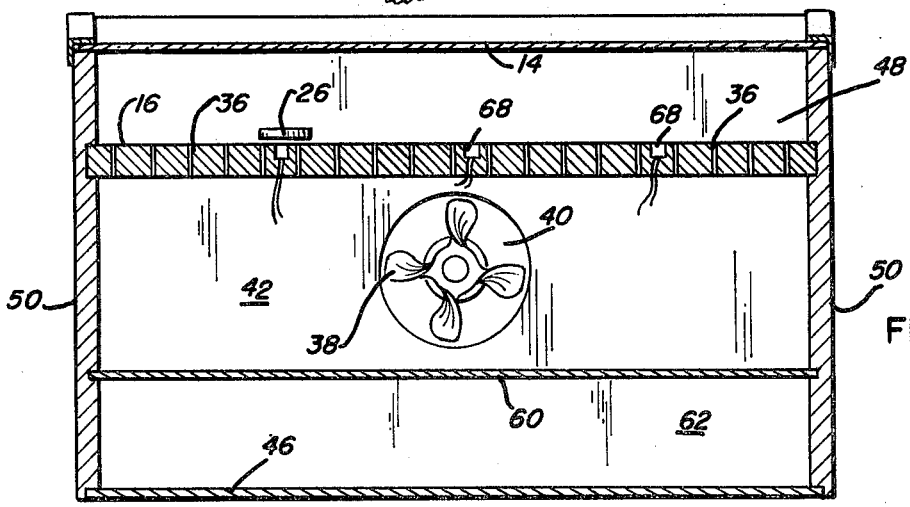
FIG. 4 is a sectional view taken generally along the line 4—4 in FIG. 3 to illustrate a portion of the air supply system in a direction transverse to the main path of air movement.
Figure 5:
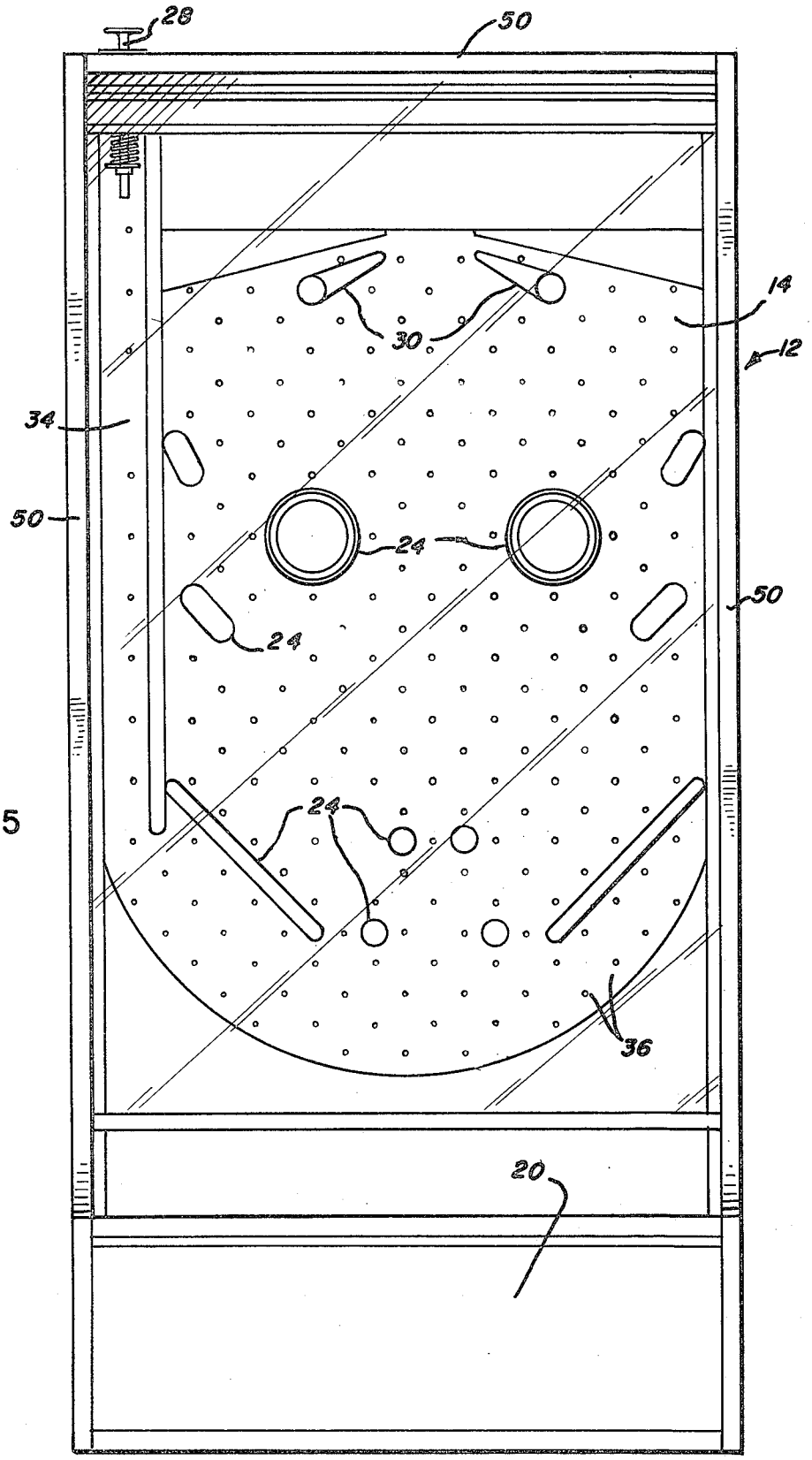
FIG. 5 is a top elevational view of the apparatus as shown in FIG. 1.

To enable the game piece 26 to move over and along the surface of the board 16, the board is perforated with a matrix of spaced holes or perforations 36, as shown in FIGS. 1–5, and air is transmitted through the holes 36 to hold the game piece 26 slightly above the board surface on a cushion of air supplied by a fan 38. As a specific example although no limitation is intended, the holes 36 may be formed in alternately offset rows and columns as best seen in FIGS. 2 and 5 on centers of substantially 1 inch, while the diameter of the disc-shaped game piece is somewhat larger than 1 inch and in the neighborhood of about 2 inches.

Figure 3:
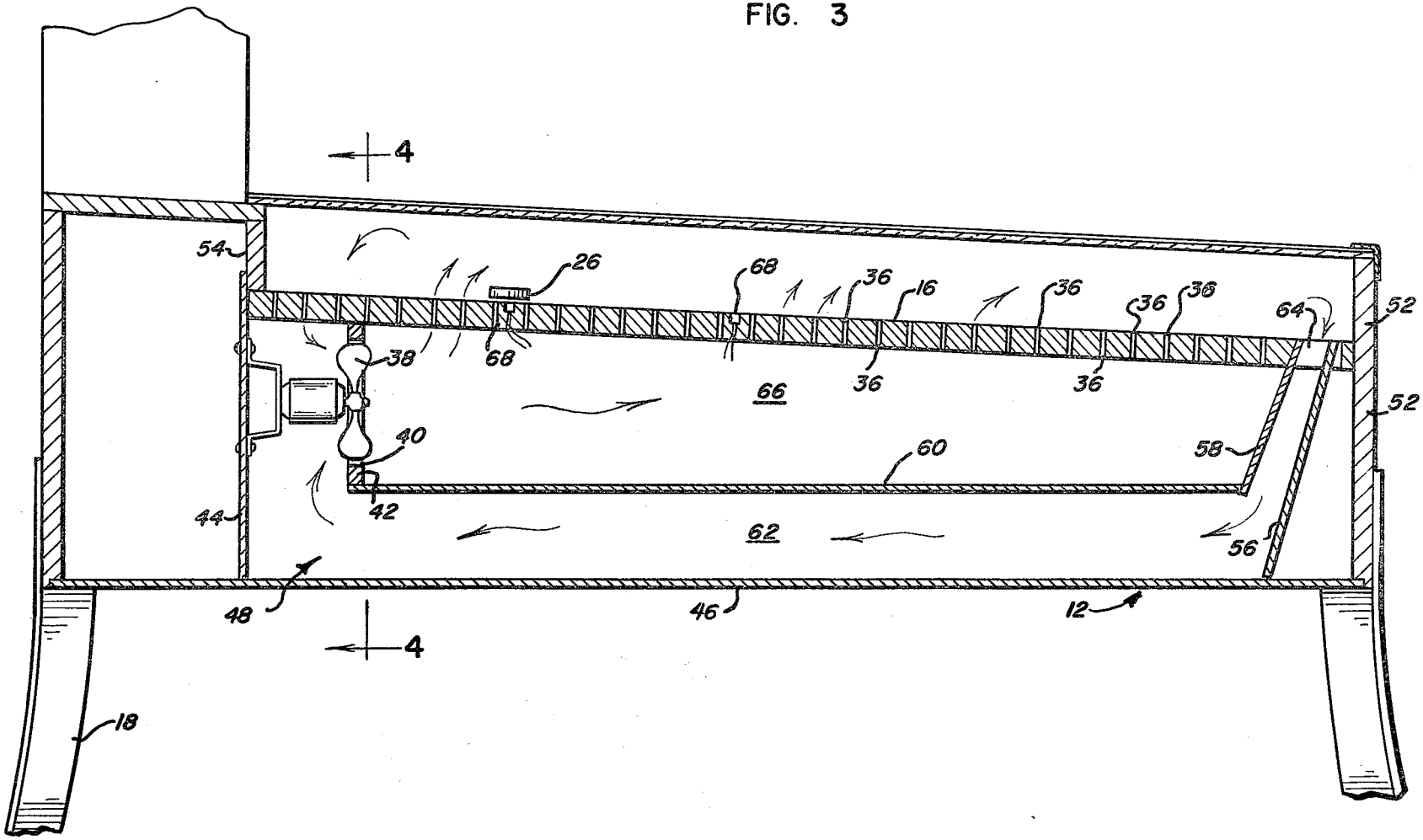
FIG. 3 is a sectional view taken largely along the longitudinal axis of the apparatus shown in FIG. 1 to illustrate the primary path of air movement.

As shown in FIGS. 3 and 4, the fan 38 is located adjacent an opening 40 of a wall 42 positioned adjacent the upper end of board 16. The fan 38 is supported by a bracket attached to back wall 44 forming one closure member between the upper end of board 16 and the bottom wall 46 of the housing 12, for a closed air stream recirculating chamber or system 48.

The closed recirculating chamber is formed by housing 12 and comprises sidewalls 50, and front wall 52 together with a rear wall 54 at the upper end of board 16 extending to the cover 14, which forms one boundary for the closed air system 48. A pair of spaced partition walls 56 and 58 diverging at an angle of about 5° are provided adjacent the front wall 52 and beneath the front end of board 16. A wall 60 connected between wall 58 and wall 42 provides a return air path 62 for air exiting through passages 64 at the lower end of board 14 to thereby supply air to the fan 38. Fan 38 supplies the air through the opening 40 in wall 42 to a plenum chamber 66 formed by board 16 and walls 58 and 60, through holes 36 to the space between board 16 and cover 14 and the air recirculates through passages 64 at the front or lower end of board 16 and the return air path or passage 62 extending between walls 46, 56, 58 and 60 to the opening 40. It will be noted that the cover 14 together with passage 64 assists in controlling the pressure drop in the chamber defined between board 16 and cover 14 so that the game piece does not move upwardly or vertically in excessive or erratic fashion.

While the board 16 may be provided with conventionally operable springs and contacts for registering player scores, the present invention also contemplates the use of photosensitive means, or cells 68 seen in FIGS. 3 and 4. The cells 68 may be of either the photoelectric or photoresistive type and when the game piece 26 passes thereover, light transmitted through cover 14 is interrupted sufficiently to enable the cells to provide a signal of sufficient magnitude to easily register a score.

In operation, the fan 38 is controlled by a start switch 70 (FIG. 1) to continuously supply air through the holes or passages 36. A game piece 26 located in guideway 34 is moved upwardly along the board through the guideway 34 by operation of the plunger 28 under control of the player. As the game piece 26 exits the guideway and its upward momentum is dissipated or it strikes either wall 50 or 54, it starts to slide down or in one direction along the incline of board 16 supported on a cushion of air so that its movement is extremely rapid. As the game piece moves, it may encounter various ones of obstacles 24 and either operates various scoring springs and contacts or passes over the aforementioned sensors 68 to register a score for the player at indicia 22. The light weight of the plastic game piece, however, ensures that little wear occurs at the obstacles or rail of the board, which are usually appropriately lined with a soft rubber-like material.

When the game piece approaches flippers 30, the player on successfully timing the approach, operates flippers 30 to reverse the direction of movement of the game piece. The game piece therefore again moves upwardly along the board 16 and when its momentum is again dissipated, it again reverses direction to enable additional scores to be registered and the play to be repeated as often as the player's skill commands.

When the game piece passes between or around the flippers 30 to terminate the play, it enters a conventional hopper and is returned to the guideway in a conventional fashion, such as by a spring-biased member or by an appropriate manually operated lever. Usually this is done by retraction of rod 28 to cause a game piece to enter the guideway.

It is to be understood that various modifications and substitutions may be made by those skilled in the art without departing from the novel spirit and scope of the invention.

What is claimed is:

1. An amusement device of the pinball type comprising:

a game piece;

a housing having a transparent cover member;

a board having an inclined surface visible through said transparent member and carrying score sensing apparatus for actuation by said game piece moving over said inclined surface;

means for supplying an air cushion through said board for supporting said game piece above said board on said air cushion and enabling said game piece to move along said inclined surface under the influence of gravity;

means carried by said housing at a fixed location for enabling said game piece to be moved upwardly along said surface and against the influence of gravity; and means for recirculating said air.

2. The device described in claim 1, in which said score sensing apparatus comprises a photosensitive element.

3. An amusement device as described in claim 1, said recirculating means comprising a closed air path defined by said housing, and including air moving means in said closed air path.

4. An amusement device as described in claim 3, said closed air path including a passage in said board for passing air to said air moving means.

5. An amusement device as described in claim 4, in which said passage is located at the bottom portion of said board, and a wall located between said board and a wall of said housing to communicate air from said passage to said air moving means.

6. An amusement device incorporating apparatus enabling a single player to maintain a game piece in movement along a reversible path, the improvement comprising:

an inclined board having means for passing an airstream therethrough; a housing for defining a closed path for said airstream, with one boundary of said closed path defined by a transparent cover member for said housing, and including air moving means in said closed air path;

said closed air path including a passage in said board for passing air to said air moving means, said passage being located at a bottom portion of said board, and a wall located between said board and a wall of said housing to communicate air from said passage to said air moving means;

a game piece adapted to be supported by said airstream for movement along the incline of said board under the influence of gravity; and means for reversing the direction of movement of said game piece along said inclined board and against the influence of gravity.

7. A game apparatus comprising:

a housing which defines a playing area with a game board for supporting a playing piece, said game board comprising a perforated board;

a fan for forcing air through the perforations of said perforated board from underneath said board;

a light-weight disc playing piece for moving on said perforated board over an air cushion provided by said air forced through said perforated board, said playing piece being unable to move over and along the surface of said board without said air cushion;

electronically operated and manually controlled means located within said playing area for engaging said disc type playing piece to move the same away from the player;

means located in said playing area for sensing movement of said playing piece and actuated by said playing piece during movement thereof on said air cushion; and indicating means responsive to actuation of said sensing means.

8. A game apparatus as described in claim 7, in which said sensing means comprises light sensors which are actuated when said playing piece passes over said light sensors.

9. A game apparatus as described in claim 7, including a transparent member covering said playing area and defining a substantially closed volume above said game board; and means for substantially recirculating the air forced through said perforated board.

10. A game apparatus which comprises:

a housing which defines a playing area with a game board for supporting a playing piece, said game board comprising a perforated board;

a transparent member covering said playing area and defining a substantially closed volume above said game board;

a fan for forcing air through the perforations of said perforated board from underneath said board;

a light-weight disc type playing piece for moving on said perforated board over an air cushion provided by said air forced through said perforated board, said playing piece being unable to move over and along the surface of said board without said air cushion;

means for substantially recirculating the air forced through said perforated board;

electronically operated and manually controlled means located within said playing area for propelling said playing piece to move the same in a direction away from a player;

a plurality of light sensors located in said playing area for actuation by said disc type playing piece during movement thereof on said air cushion; and indicating means located on said apparatus and responsive to actuation of said light sensors.

* * * * *